United States Patent [19]

Peak

[11] 3,969,786

[45] July 20, 1976

[54] WALL BUMPER

[75] Inventor: Ben Peak, Yorba Linda, Calif.

[73] Assignee: Builders Brass Works, Los Angeles, Calif.

[22] Filed: Feb. 19, 1975

[21] Appl. No.: 551,068

Related U.S. Application Data

[63] Continuation of Ser. No. 412,657, Nov. 5, 1973, abandoned.

[52] U.S. Cl. ..... 16/86 A; 85/53

[51] Int. Cl.[2] ..... E05D 15/58

[58] Field of Search ..... 16/86 A; 85/53, 55; 24/243 K, 113 R

[56] References Cited

UNITED STATES PATENTS

| | | | |
|---|---|---|---|
| 2,164,414 | 7/1939 | Long | 24/243 K X |
| 2,899,703 | 8/1959 | Johnson | 16/86 A |
| 3,050,770 | 8/1962 | Morse et al. | 16/86 A |
| 3,126,602 | 3/1964 | Adinolfi et al. | 24/113 R |
| 3,205,001 | 9/1965 | Abolins | 24/243 K X |
| 3,362,040 | 1/1968 | Gurzenda | 16/86 A |
| 3,384,938 | 5/1968 | O'Connor | 24/243 K |
| 3,484,891 | 12/1969 | Borgen | 16/86 A |
| 3,792,510 | 2/1974 | Evett | 24/243 K |

*Primary Examiner*—Roy D. Frazier
*Assistant Examiner*—Peter A. Aschenbrenner
*Attorney, Agent, or Firm*—Lyon & Lyon

[57] ABSTRACT

A bumper adapted for mounting on a wall and contacting a door or doorknob to stop the swing of the door towards the wall which is comprised of a resilient bumper which protrudes through an aperture in an annular retaining housing. The bumper has an enlarged annular base portion which abutts the interior front wall of the housing to maintain the bumper within the housing. A deformable plate is disposed within an annular channel in the wall of the housing and upon deformation maintains the bumper rigidly within the housing and provides means for securing the wall bumper to the wall.

3 Claims, 6 Drawing Figures

WALL BUMPER

BACKGROUND OF THE INVENTION

This is a continuation of application Ser. No. 412,657, filed Nov. 5, 1973, now abandoned.

Wall bumpers for doorstops are commonplace items in home and buildings and are generally secured to the baseboard or floor of a room or hallway. There are, however, several instances in which such mounting is impractical. In such cases the doorstops or bumpers are secured to the wall, usually in a position to contact the doorknob and thereby limit the opening of the door to prevent the door or doorknob from striking the wall itself. In the wall mounting of a doorstop, attempts are generally made to conceal the means by which the stop is secured to the wall in order to present a more ornamental appearance, as taught U.S. Pat. No. 3,050,770. In several applications, of which schools are a good example, the means of securing the bumper to the wall need not only be removed from plain sight, as taught in the above reference, but must be practically non-discoverable to prevent unauthorized removal of the bumper. In conjunction with a well concealed method of securing the stop to the wall, such applications also call for an extremely durable doorstop which cannot be disassembled or otherwise damaged by tampering. U.S. Pat. No. 2,899,703 is an example of a doorstop which has a well concealed method of securing these stops to the wall, however, the apparatus described therein, as in the case of other known doorstops, allow removal of the resilient bumper by merely pulling the same away from the flange which sits in a peripheral groove in the bumper. In order to withstand the treatment commonly given wall bumpers or doorstops in the schools and other public places a more durable stop is needed.

SUMMARY OF THE INVENTION

Briefly the invention comprises a wall bumper having a resilient bumper member which protrudes through an aperture in an annular retaining housing. The bumper member is held within the retaining housing by an enlarged base portion which is disposed at the rearward end thereof and is pressed against the interior wall of the retaining housing by a deformed plate which is disposed in an annular channel in the side wall of the housing. The wall bumper is then secured to the wall by a screw member extending through axially aligned holes in the bumper member and deformed plate.

It is the principal object of this invention to provide a durable wall bumper which is so constructed as to conceal the means by which the bumper is fastened to a wall.

It is another object of this invention to provide a wall bumper which once secured to a wall cannot be removed or damaged by tampering.

It is a further object of this invention to provide a wall bumper which is economical to manufacture and easy to assemble and install.

It is a further object of this invention to provide a wall bumper which in one embodiment thereof is adapted to cooperate with a doorknob having a push button type latch.

These and other objects and advantages of the instant invention will become apparent upon the following detailed description taken in conjunction with the accompanying drawing.

IN THE DRAWINGS

Figure 1:
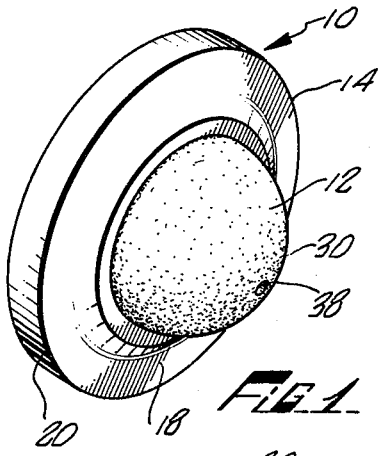
FIG. 1 is an isometric elevation of the wall bumper.

Referring now in detail to the drawings, the wall bumper 10 is seen to be comprised of a resilient bumper 12, and annular retaining housing 14 and deformable plate 16. The retaining housing 14 which is preferably cast from brass, bronze or aluminum has an annular front wall portion 18 and an annular side wall portion 20 defining an open end 22 which is adapted to abut a wall 24. An annular ridge 26 is provided at the open end of the housing which together with annular surface 29 defines an annular channel 28 in the side wall portion 20 thereof. The annular channel is adapted to receive the deformable plate 16 as will be described.

Figure 2:
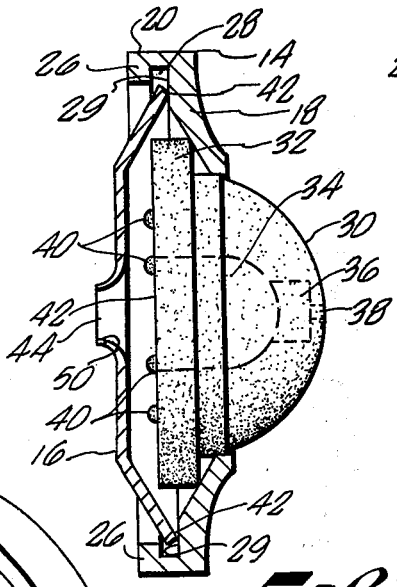
FIG. 2 is a sectional side view of the bumper showing the deformable plate within the housing prior deformation of the plate.
Figure 3:
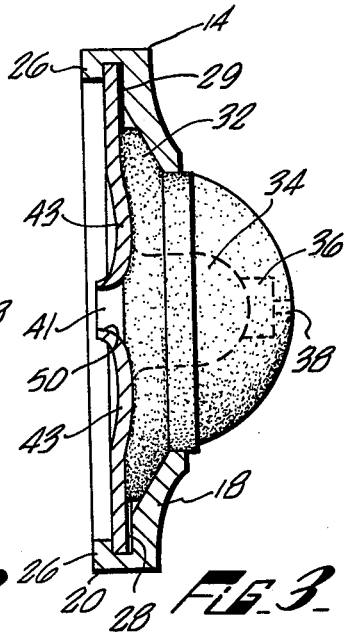
FIG. 3 is a sectional side view of the bumper showing the deformable plate within the housing after deformation of the plate.
Figure 4:
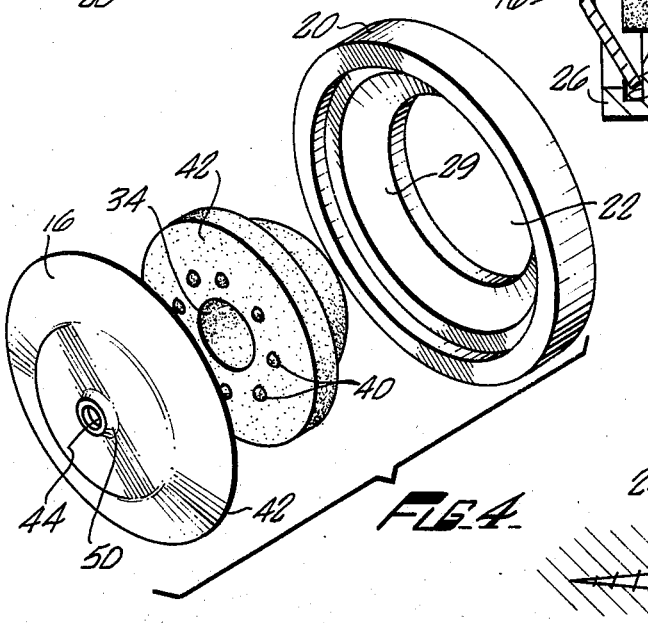
FIG. 4 is an isometric elevation showing the housing, resilient bumper and deformable plate.

In the embodiment of the resilient bumper 12 shown in FIGS. 1–5, the bumper is seen to be comprised of an outwardly projecting contact portion 30 and an enlarged base portion 32 disposed behind the contact portion. The bumper 12 also has a recessed area therein defining an enlarged rear chamber 34 which communicates with a smaller forward chamber 36. An aperture 38 is provided in the forward portion of the bumper which is axially aligned with the two chambers and provides a continuous passageway through the bumper 12. A plurality of resilient projections 40 are integrally molded with the resilient bumper 12 and are disposed at the backside 42 thereof. The resilient bumper 12 is disposed within the retaining housing 14 such that the annular base portion 32 of the bumper presses against the inner front wall portion of the retaining housing. The dish shaped deformable plate 16 is disposed within the retaining housing 14 rearwardly of the bumper 12 with the forward edge 42 of the plate resting on the annular supporting surface 29. In this position the annular edge of the plate is radially aligned with annular channel 28 in the side wall 20 of the housing as seen in FIG. 2. The plate is then pressed inwardly until a central portion 43 thereof presses firmly against the backside of the resilient bumper and projections 40 as seen in FIG. 3. During the deformation of the plate 16 from a convex to a slightly concave configuration, the extended annular edge 42 of the plate extends into the annular channel 28 in the side wall of the housing thereby firmly and permanently holding the plate 16 and bumper 12 within the housing 14.

Figure 5:
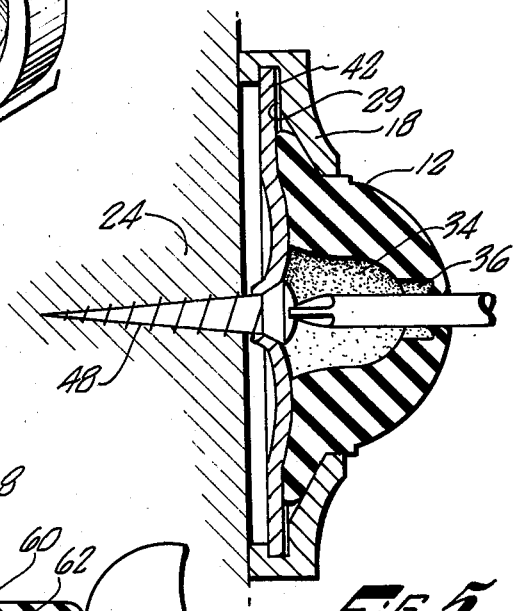
FIG. 5 is a sectional side view of the bumper shown attached to a fragment of a wall and the manner in which the screw means is engaged by a suitable tool for securing the doorstop to the wall.

The deformable plate 16 is provided with a centrally disposed aperture 44 which is in axial alignment with chambers 34 and 36 and aperture 38 of the resilient bumper 12. The wall bumper 10 is secured to a wall 24 by pushing a screw 48 through the aperture 38 in the resilient bumper 12 until the head portion of the screw abutts the deformable plate 16. A portion 50 about aperture 44 in the deformable plate is preferably flaired upwardly to receive the head of the screw. The threaded portion of the screw is then driven into the wall by the use of a screw driver which can be inserted through aperture 38 and chambers 34 and 36 of the resilient bumper 12 as seen in FIG. 5. Aperture 38 is smaller than the head portion of the screw and so the screw is hidden from view and the wall bumper 10 is securely affixed to the wall and cannot be removed or damaged by tampering without specific knowledge of the construction of this device.

Figure 6:
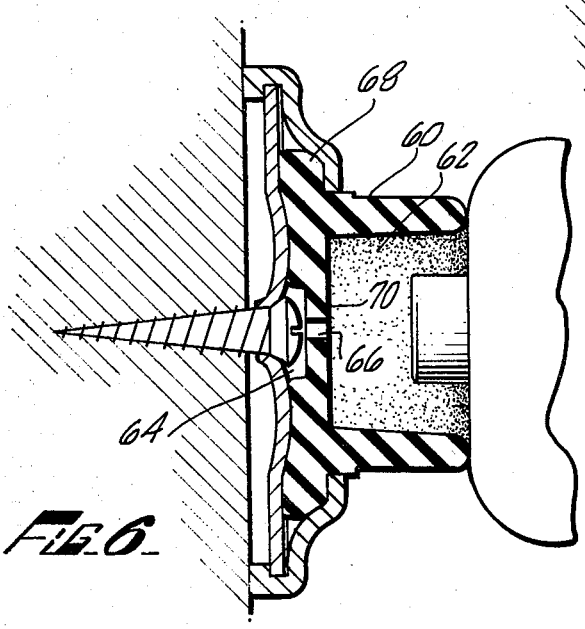
FIG. 6 is a sectional side view of a second embodiment of the bumper secured to a wall and in contact with a doorknob having an outwardly extending push button latch.

An alternate embodiment of the wall bumper is shown in FIG. 6. In this embodiment, the resilient bumper 60 has an open recessed portion or chamber 62 in the forward end thereof which communicates with a recessed area 64 in the base portion of the bumper through a centrally disposed aperture 66. As bumper 12, resilient bumper 60 has an enlarged base portion 68 and resilient projections (not shown). Resilient bumper 60 is installed in the same fashion as bumper 12 and differs only in the inclusion of the open recess to cooperate with a doorknob having a push button type latch as shown in FIG. 6. It is apparent from the drawings that the inner wall portion 70 surrounding central aperture 66 is sufficient to hide the head of the securing screw from view and thereby protects this embodiment of the wall bumper from theft and damage.

Various changes and modifications may be made in carrying out the present invention without departing from the scope and spirit thereof. Insofar as these changes and modifications are within the purview of the appended claims, they are to be considered as part of the invention.

I claim:

1. A wall bumper comprising a housing having a forward wall portion with an aperture therethrough and an annular side wall portion defining an open end adapted to abut a wall, said wall portion having an annular channel therein, the forward wall of said channel defining a substantially flat support surface, a resilient bumper member having a forward contact portion extending through said aperture and an enlarged rear portion abutting the interior of said forward wall portion of said housing, a retaining plate having an aperture therethrough and being disposed within said housing rearwardly of said bumper member, the perimeter portion of said plate being disposed within said annular channel in the side wall portion of said housing and in contact with said support surface and the central portion of said plate being deformed to press said enlarged portion of said bumper member against the interior of said forward wall portion of said housing thereby securing said resilient bumper member within said housing and a threaded fastening means adapted to extend through said aperture in said retaining plate and into a wall to which said bumper is to be secured.

2. The combination of claim 1 wherein said bumper member has a recessed area therein and an aperture in the forward contact portion thereof communicating with said recessed area, one end of said threaded fastening means being disposed against said retaining plate and spaced behind said aperture in said bumper member, said aperture being smaller than said end of said fastening means whereby said end of said fastening means is concealed from view.

3. The combination of claim 1 wherein said forward contact portion has a chamber therein, said chamber being opened at its forward end and said base portion has a recess therein, said recess terminating in a flexible wall, said wall having an opening therethrough communicating said recess with said open chamber, one end of said threaded fastening means being disposed against said retaining plate and spaced behind said aperture in said bumper member, said aperture being smaller than said end of said fastening means whereby said end of said fastening means is concealed from view.

* * * * *